US006427061B1

(12) United States Patent
Miura et al.

(10) Patent No.: US 6,427,061 B1
(45) Date of Patent: Jul. 30, 2002

(54) FLASH DEVICE AND IMAGE FORMING DEVICE THAT USES FLASH DEVICE

(75) Inventors: Kuniyuki Miura, Toyokawa; Masao Watanabe, Matsumoto, both of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/709,392

(22) Filed: Nov. 13, 2000

(30) Foreign Application Priority Data

Nov. 16, 1999 (JP) ..... 11-325467

(51) Int. Cl.[7] ..... G03G 15/20
(52) U.S. Cl. ..... 399/336
(58) Field of Search ..... 399/67, 320, 335, 399/336, 337

(56) References Cited

U.S. PATENT DOCUMENTS 4,160,595 A * 7/1979 Ito et al. ..... 399/320 X
4,444,487 A * 4/1984 Miller et al. ..... 399/337
4,768,057 A * 8/1988 Kumada et al. ..... 399/336
4,928,147 A * 5/1990 Baumann et al. ..... 399/337
4,992,923 A * 2/1991 Mitsuya et al. ..... 399/336 X
5,428,434 A 6/1995 Hirao
5,521,689 A 5/1996 Miyakoshi
5,526,107 A * 6/1996 Bronstein ..... 399/299
5,974,296 A 10/1999 Suketomo et al. ..... 399/336

FOREIGN PATENT DOCUMENTS

JP 57-172377 * 10/1982
JP 60-128475 7/1985

* cited by examiner

*Primary Examiner*—Sandra Brase
(74) *Attorney, Agent, or Firm*—Morrison & Foerster LLP

(57) ABSTRACT

A flash device includes a DC power supply, a flash lamp, and a plurality of charge/discharge elements, which are charged via a charging path by the DC power supply and discharge electric charge via a discharging path to the flash lamp. A first switch selectively establishes (a) a parallel state in which the charge/discharge elements are connected in parallel with one another, and connected to the DC power supply via the charging path and (b) a series state in which the charge/discharge elements are connected in series with the flash lamp via the discharging path, and connected in series with one another. A second switch is positioned in the charging path between the DC power supply and the charge/discharge elements, and selectively connects and disconnects the charge/discharge elements to and from the DC power supply. A controller has the second switch perform connection and has the first switch establish the parallel state to have the charge/discharge elements charged. The controller has the second switch perform disconnection and has the first switch establish the series state to have the flash lamp emit light.

28 Claims, 5 Drawing Sheets

FLASH DEVICE AND IMAGE FORMING DEVICE THAT USES FLASH DEVICE

This application is based on application No. 11-325467 filed in Japan, the content of which is hereby incorporated by reference.

BACKGROUND OF THE INVENTION (1) Field of the Invention

The present invention relates to a flash device used for an image forming device, a camera, and the like, and more specifically to a technique to supply power to the flash lamp.

(2) Description of Related Art

Some electrophotographic image forming devices, such as a laser printer, form a visible image from an electrostatic latent image by using toner, transfers the toner onto a recording medium such as a sheet of paper, and has a flash lamp in a fixing device flash to fix the transferred toner onto the sheet of paper. As another example of a flash device use, a flash device is used for a camera, and has a flash lamp flash to irradiate a subject. An example of such a flash device is disclosed by Japanese Laid-Open Patent Application No. 60-128475.

FIG. 1 is a circuit diagram showing a construction of this flash device. As shown in the figure, the flash device comprises the following elements: a diode bridge rectifier BR (hereafter just called "bridge rectifier"), which rectifies an AC (alternating current) voltage of 200 volts outputted from a commercial AC power supply AC; a flash lamp FL that is a discharge tube into which xenon gas is filled; diodes D1~Dn which prevent a backward current; discharge capacitors C1~Cn; and switches SW1~SWn−1. Under control of a flash power supply control circuit (not shown in the figure), these switches SW1~SWn−1 are switched to selectively establish a first connection state (shown by solid lines in the figure) and a second connection state (shown by dotted lines).

When the capacitors C1~Cn should be charged, the switches SW1~SWn−1 are switched to establish the first connection state, where the capacitors C1~Cn are connected in parallel and the bridge rectifier BR is connected to negative terminals of the capacitors C1~Cn. As a result, the capacitors C1~Cn are each charged up to 280 volts, which are equal to a peak output voltage of the bridge rectifier BR.

After the capacitors C1~Cn have been charged in this way, the switches SW1~SWn−1 are switched to establish the second connection state to have the flash lamp FL emit light. As a result, negative terminals and positive terminals of the capacitors C1~Cn are connected, and the capacitors C1~Cn are connected in series with the flash lamp FL. This boosts a voltage applied to between main electrodes of the flash lamp FL to an n-fold voltage of one capacitor. When a trigger signal is applied to a trigger electrode of the flash lamp FL to which the boosted voltage is impressed, xenon gas inside the flash lamp FL is excited, and electrical resistance of the flash lamp FL reduces. As a result, electrostatic energy is supplied from the capacitors C1~Cn to the flash lamp FL, so that a discharge current flows between the main electrodes, and the flash lamp FL emits light.

With a conventional flash device like the above, when the output voltage of the bridge rectifier BR is lowered, each capacitor can have a low withstand voltage, so that the cost of parts in the flash device can be reduced.

However, with the conventional flash device, the capacitor C1 continues to be charged due to an output from the bridge rectifier BR while the flash lamp FL emits light. As a result, voltage continues to be supplied to the flash lamp FL, so that the flash lamp FL unnecessarily continues to emit the light. In addition, the flash lamp FL continues to emit the light even after the connection state has been switched back to the first connection state because power continues to be supplied via the bridge rectifier BR to the flash lamp FL. In this way, a conventional flash device has a drawback in that it cannot stop the flash lamp FL from emitting light with a desired timing and control a quantity of light emitted by the flash lamp FL.

SUMMARY OF THE INVENTION

The present invention is made in view of the above problems, and aims to provide a flash device that can reliably control illumination of a flash lamp.

The above object can be achieved by a flash device which includes: a DC power supply; a flash lamp; a charging path; a discharging path; a first group of charge/discharge elements that are charged by the DC power supply, and discharge electric charge to the flash lamp; a first switch that selectively establishes (a) a parallel state in which the first group of charge/discharge elements are connected in parallel with one another, and connected to the DC power supply via the charging path and (b) a series state in which the first group of charge/discharge elements are connected in series with the flash lamp via the discharging path, the first group of charge/discharge elements being connected in series with one another; a second switch that is positioned in the charging path, and selectively connects and disconnects the first group of charge/discharge elements to and from the DC power supply; and a controller that establishes a first control state to have the first group of charge/discharge elements charged, and a second control state to have the flash lamp emit light. In the first control state, the second switch performs connection and the first switch establishes the parallel state. In the second control state, the second switch performs disconnection and the first switch establishes the series state.

Unlike with a conventional flash device, capacitors in the above flash device are not charged during illumination by the flash device. This reliably prevents the present flash lamp from continuing to emit light unnecessarily, and therefore an amount of the light can be suitably controlled.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENT

The following describes a flash device according to the present embodiment of the present invention, using an example in which the present flash device is used in a fixing unit of a laser printer.

Overall Construction

Figure 1:
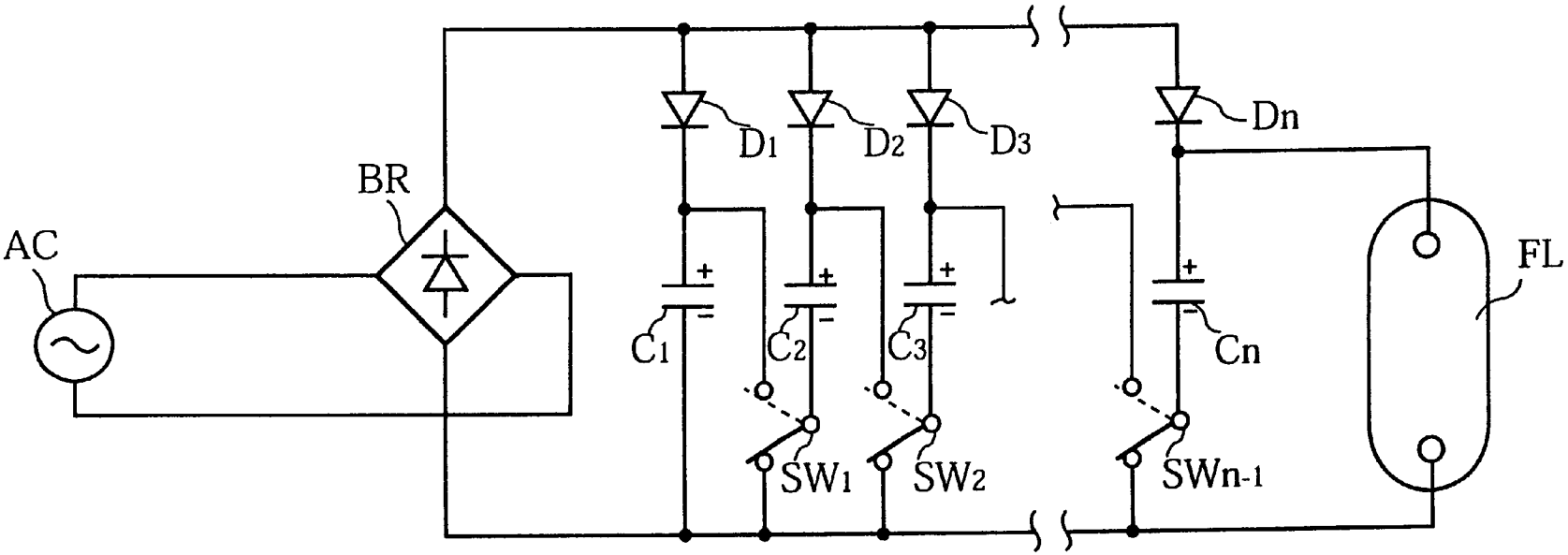
FIG.1 PRIOR ART
FIG. 1 shows a construction of the conventional flash device.
Figure 2:
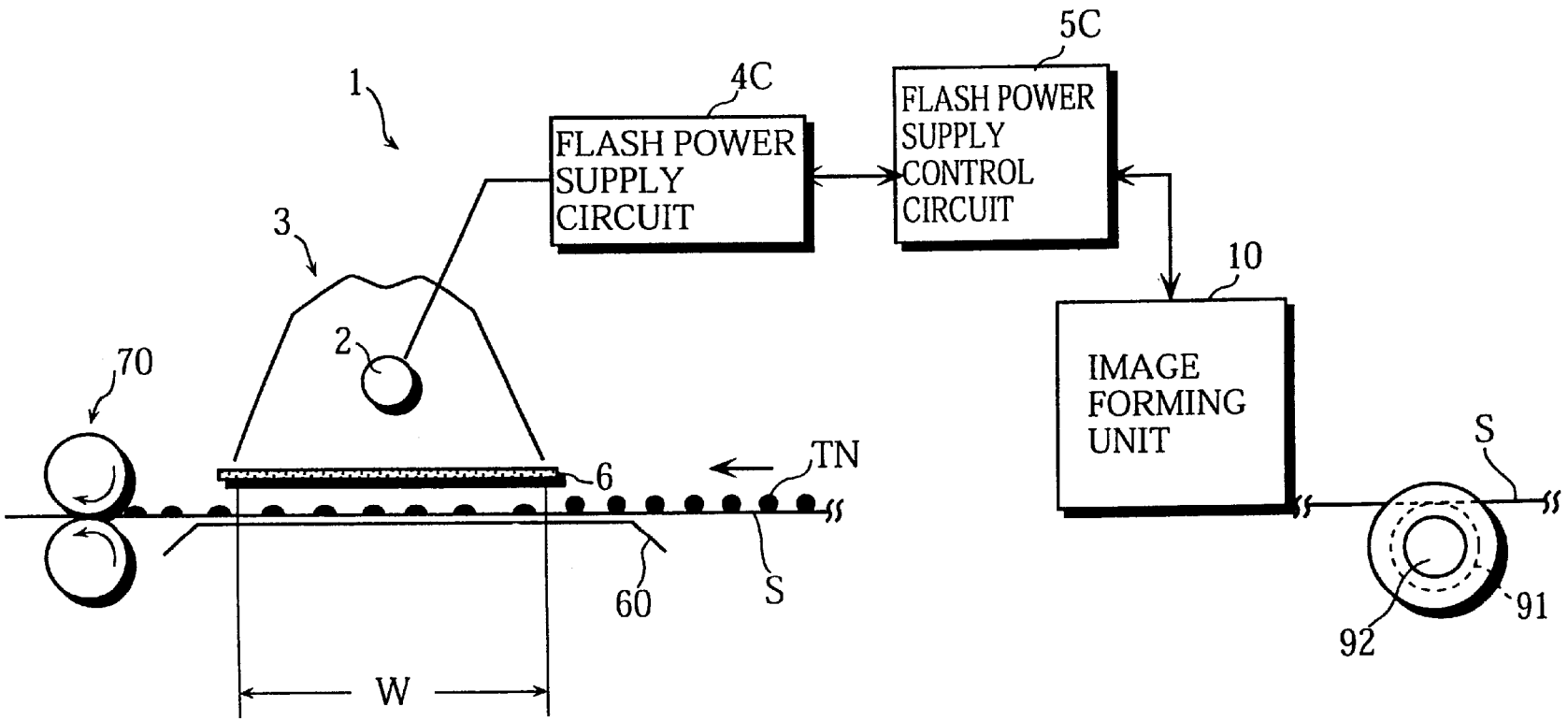
FIG. 2 shows constructions of a flash device 1 used in an image forming device and peripheral units.

FIG. 2 shows a construction of the present flash device 1 and peripheral units used in a laser printer (hereafter, just called a "printer").

The printer includes the flash device 1 and an image forming unit 10 that forms an image by transferring toner TN onto a sheet of paper S.

The image forming unit 10 forms a toner image according to the so-called electrophotography, and includes the following elements (not shown in the figure): a photosensitive drum that rotates at a predetermined angular speed; a scanning unit for having a laser beam, which has been light-modulated, scan a surface of the photosensitive drum; a cleaner positioned near the photosensitive drum; an eraser lamp; a sensitizing charger; a developing unit; and a transfer charger.

Before the photosensitive drum is exposed to the laser beam, remaining toner particles on the surface of the photosensitive drum are removed by the cleaner. The photosensitive drum is then irradiated by the eraser lamp to have its electric charge removed, and then charged uniformly by the sensitizing charger. When this photosensitive drum is exposed to the laser beam, an electrostatic latent image is formed on the surface of the photosensitive drum. The electrostatic latent image becomes visible using the toner TN, which includes black toner and color toner of yellow, magenta, and cyan.

In synchronization with the above image forming operations, the-sheet of paper S (which is of "A3" size and is in landscape configuration, for instance) is conveyed at a predetermined system speed (100 mm/second, for instance) to a predetermined transfer position between the photosensitive. drum and the transfer charger. Due to electric charge of the transfer charger, the toner TN is transferred onto the transfer position on the conveyed paper S. The above system speed is detected by a rotary encoder 92 mounted around a rotary shaft of a sheet feeding roller 91. The rotary encoder 92 sends the detected speed as a paper feeding pulse to the image forming unit 10 and the flash device 1.

The toner TN transferred onto the paper S will come off if it is touched, and is thus in unstable state. Accordingly, the flash device 1 produces a flash of light to fix the toner TN onto the paper S being conveyed at the above system speed.

Overall Construction of Flash Device 1

The flash device 1 includes the following elements: a flash lamp 2; a reflecting umbrella 3 that covers the flash lamp 2 from the above, is open toward the paper S, and has a vertical cross-sectional shape close to an inverted-U letter to surround the flash lamp 2; a dust-resistant glass 6 positioned directly below the flash lamp 2; a flash power supply circuit 4C that supplies power for the flash lamp 2 to produce light; and a flash power supply control unit 4C that performs overall control over the flash power supply circuit 4C. The flash device 1 has the flash lamp 2 emit light in every predetermined cycle, and fuses the toner TN onto the paper S conveyed onto a guide plate 60 by using light emission energy of the light. This fusing is performed from one end of the paper S to the other end in a direction (hereafter called a "paper-feeding direction") in which the paper S is conveyed.

The flash lamp 2 is a discharge lamp containing a glass tube into which xenon gas is filled. Main electrodes 21 and 22 (see FIG. 3) are provided at both ends of the glass tube, and a trigger electrode 23 (see FIG. 3) is provided in a wall of the glass tube. When a trigger voltage is impressed to the trigger electrode 23 while the flash power supply circuit 4C supplies a predetermined voltage to between the main electrodes 21 and 22, a puncture occurs inside the glass tube so that a main discharge is caused between the main electrodes 21 and 22 all at once. This produces a high-spectrum flash of light in an IR (infrared) range for a predetermined period. Specifications of the flash lamp 2 of the present embodiment are as follows: a gap length between the main electrodes 21 and 22 of 500 mm, which is longer than a width of 420 mm of the paper S; and a discharge starting voltage of 1,500 volts. The flash lamp 2 has a constant-current characteristic when operating in a voltage about between 600 and 840 volts. The flash power supply circuit 4C supplies a voltage (1,600 volts, for instance) higher than the above discharge starting voltage to the main electrodes 21 and 22 when the flash lamp 2 starts discharging. As soon as the discharge has started, the flash power supply circuit 4C supplies a voltage of 840 volts, which is a maximum voltage that allows the flash device 2 to have the constant-current characteristic. While the flash lamp 2 emits light, the flash lamp 2 is driven in a constant current, and the flash power supply control circuit 5C controls light emission energy during this period. The flash power supply circuit 4C and the flash power supply control circuit 5C are described later in detail.

The reflecting umbrella 3 encloses the flash lamp 2 so as to uniformly distribute light from the flash lamp 2 on a predetermined fixed region directly below the flash lamp 2. Here, the "fixed region" is 50 mm long (shown as "W" in the figure and hereafter called "a fixed width") in the paper-feeding direction and 420 mm long in a direction perpendicular to the paper-feeding direction, with the latter being equal to the width of the paper S.

When being exposed to light emission energy produced by the flash lamp 2, the toner TN transferred on the paper S is fused and fixed into the fixed region, entering into between fibers of the paper S. The paper S is then conveyed along the guide plate 6 to an ejecting roller 70, and discharged onto an output tray (not shown in the figure).

Construction of Flash Power Supply Circuit 4C

The following describes a construction of the flash power supply circuit 4C that supplies power to the flash lamp 2.

Figure 3:
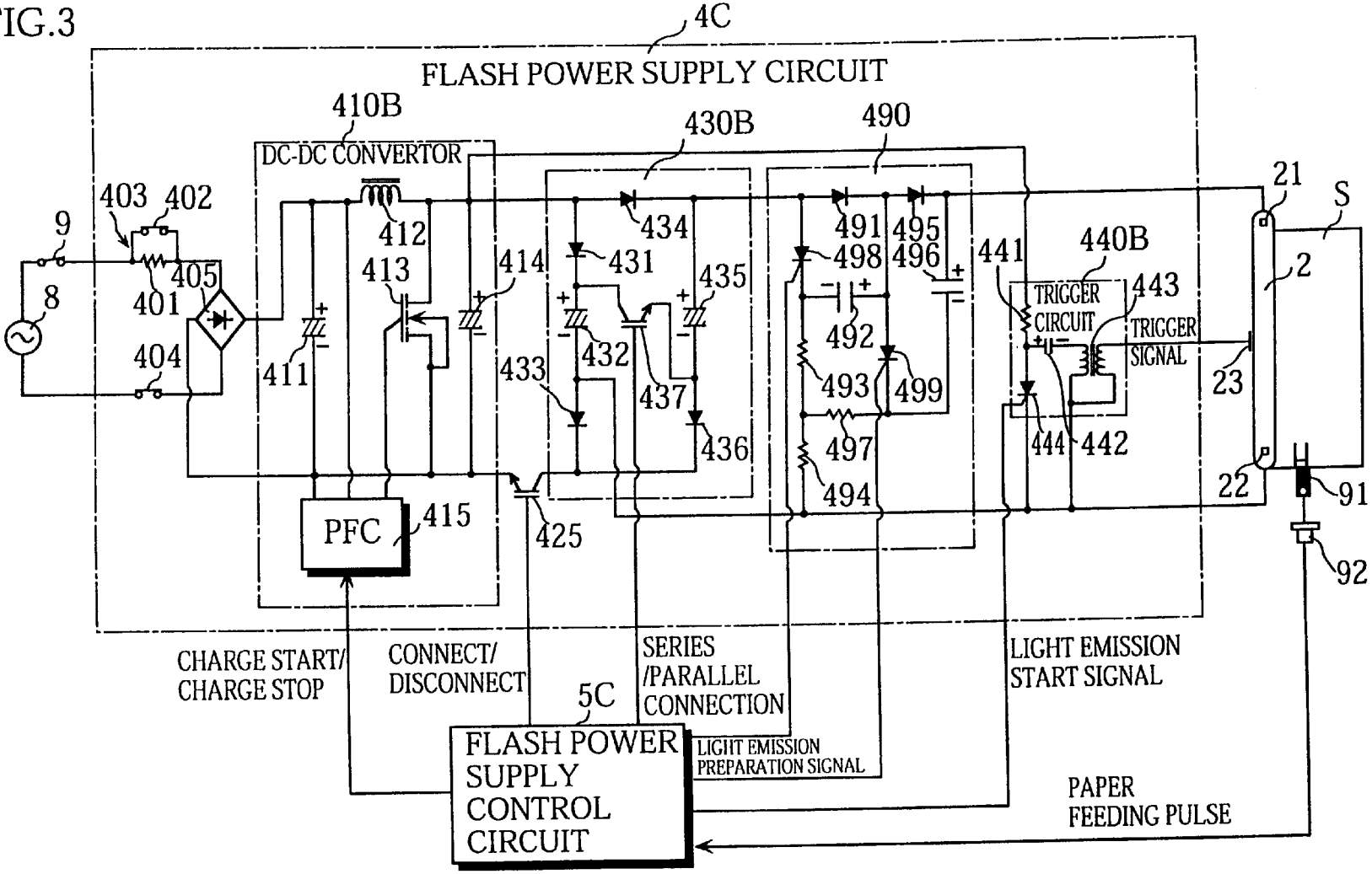
FIG. 3 is a circuit diagram showing constructions of a flash power supply circuit 4C in the flash device 1 and circuits on its periphery.

FIG. 3 is a block diagram showing constructions of the flash power supply circuit 4C and circuits on its periphery. The flash power supply circuit 4C includes a bridge rectifier 405, a DC-DC convertor 410B, a main bank capacitor circuit 430B, an auxiliary light emission starting circuit 490, a trigger circuit 440B, and an insulated gate bipolar transistor (hereafter "IGBT") 425 that controls charging by selectively performing connection and disconnection.

The bridge rectifier 405 rectifies an AC voltage (200 volts, 15 amperes, for instance) supplied via the power switch 9 from a commercial AC power supply 8. In a path between the power switch 9 and the bridge rectifier 405, an inrush current protecting circuit 403 is provided. This inrush current protecting circuit 403 contains an inrush current suppressing resistor 401 of high resistance, and a relay switch 402 connected in parallel with the inrush current suppressing resistor 401. The inrush current protecting circuit 403 prevents an inrush current higher than a predetermined value from flowing through the bridge rectifier 405 and the DC-DC converter 410B before electric charge of a certain amount is accumulated in the main bank capacitors 432 and 435 in the main bank capacitor circuit 430B. To achieve this, the relay switch 402 is switched to OFF for a predetermined time, and the inrush current suppressing resistor 401 prevents a current higher than a predetermined value from flowing. When the electric charge of the certain amount has been accumulated in-the main bank capacitors 432 and 435 and the current higher than a predetermined value no longer flows, the relay switch 402 is switched to ON.

In a path between the commercial AC power supply 8 and the bridge rectifier 405, another relay switch 404 is provided to stop power supply from the commercial AC power supply 8 when the power switch 9 is ON. The relay switches 402 and 404 are switched between ON and OFF under control of the flash power supply control circuit 5C.

The DC-DC converter 410B is of the power-factor improvement type, for instance, which achieves a zero difference between a phase of a rectified current and a phase of a rectified voltage that are outputted from the bridge rectifier 405. The DC-DC converter 410B is a non-insulated switching power supply that raises an output voltage higher than an input voltage, and includes the following elements: a smoothing capacitor 411; a high-frequency boosting choke coil 412; a switching transistor 413; a high-frequency smoothing capacitor 414; and a power-factor controller (PFC) 415.

On receiving a charge start instruction from the flash power supply control circuit 5C, the PFC 415 has the switching transistor 413 perform switching at a high speed. As a result, switching is performed on a rectified current passing through the high-frequency choke coil 412, and a voltage between terminals of the capacitor 414 is boosted to DC 420 volts. This voltage is outputted via the IGBT 425, which controls charging operations, to the main bank capacitor circuit 430B. On the other hand, when receiving a charge stop instruction from the flash power supply control circuit 5C, the PFC 415 stops the switching transistor 413 from performing switching. In this case, a current outputted from the bridge rectifier 405 flows through the high-frequency choke coil 412, and a voltage between the terminals of the capacitor 414 becomes 280 volts, which is to say, an output voltage of the DC-DC convertor 410B becomes 280 volts.

The IGBT 425 has a construction into which a reverse-blocking triode thyristor, such as a pnpn Silicon Controlled Rectifier (SCR; a trademark of General Electric Co.), and a metal-oxide semiconductor field-effect transistor (MOSFET) are combined. The IGBT 425 operates in a high voltage and a high current, and is a three-terminal bipolar MOS compound semiconductor switching element which has short turn-on and turn-off time. On receiving a high signal that is a "connect" signal, the IGBT 425 becomes ON, so that the output terminal of the DC-DC convertor 410B is connected to the main bank capacitor circuit 430B. On receiving a low signal that is a "disconnect" signal, the IGBT 425 becomes OFF and disconnects the output terminal of the DC-DC convertor 410B from the main bank capacitor circuit 430B.

The main bank capacitor circuit 430B includes the following elements: two main bank capacitors 432 and 435; diodes 431, 433, 434, and 436 which prevent a backward current, and of which the diodes 431 and 433 are connected in series with the main bank capacitor 432, and the diodes 434 and 436 are in series with the main bank capacitor 435; and an IGBT 437 that is positioned between a positive terminal of the main bank capacitor 432 and a negative terminal of the other main bank capacitor 435. This IGBT 437 switches a connection state of the main bank capacitor circuit 430B between a series connection and a parallel. connection.

The flash power supply control circuit 5C outputs a low signal, which indicates a parallel connection, when the main bank capacitors 432 and 435 are charged. On receiving this low signal, the IGBT 437 is switched to OFF so that the positive terminal of the main bank capacitor 432 and the negative terminal of the main bank capacitor 435 are disconnected, and these two capacitors 432 and 435 are arranged in parallel. When the IGBT 425, which controls charging operations, is switched to ON with the two capacitors 432 and 435 being in parallel, a voltage of 420 volts outputted from the DC-DC convertor 410B is impressed via the diodes 431, 433, 434, and 436 to the main bank capacitors 432 and 435, so that the main bank capacitors 432 and 435 are each charged fully up to 420 volts. Hereafter, this voltage is called a "charging completion voltage (Vcs)".

After the main bank capacitors 432 and 435 have been fully charged and before the flash lamp 2 should emit light, the flash power supply control circuit 5C outputs a high signal, which indicates a series connection. As a result, the IGBT 437 is switched to ON, and the positive terminal of the main bank capacitor 432 is connected to the negative terminal of the main bank capacitor 435, and thus the two main bank capacitors 432 and 435 are connected in series with the flash lamp 2. This connection state allows 840 volts, i.e., a sum of voltages "Vcs" of the two main bank capacitors 432 and 435 to be applied to the main electrodes 21 and 22 of the flash lamp 2. When the IGBT 437 is switched from ON-to OFF and the main bank capacitors 432 and 435 are arranged in parallel, a discharge path to the two main electrodes 21 and 22 is disconnected, so that the flash lamp 2 stops emitting light.

The main bank capacitors 432 and 435 are electrolytic capacitors that have a capacity "C" (C=12,500 $\mu$F (farad), for instance) relatively larger than a conventional capacity of 200 $\mu$F, and a withstand voltage of about 450 volts. The main bank capacitors 432 and 435 store, in total, electrostatic energy "E" ($E=(C*(2*Vcs)^2)/2 \approx 2200J$ (joule)) that is sufficiently higher than a light emission energy of, for instance, 400J, required by the flash lamp 2 to produce light once.

The main bank capacitors 432 and 435 accumulate electrostatic energy because the DC-DC convertor 410B cannot directly supply the electrostatic energy sufficient for the flash lamp 2 to emit light once due to a limited capacity of the commercial AC power supply 8.

The main bank capacitors 432 and 435 accumulate the sufficiently higher electrostatic energy for the following reason. By allowing the main bank capacitors 432 and 435 to store sufficient electrostatic energy even after they have supplied light emission energy for one emission of light, a decrease in a voltage "Vc" of each of the main bank capacitors 432 and 435 can be minimized.

Here, an equation (1) below can be satisfied when the above light emission energy is "E", a total of capacities of the main bank capacitors 432 and 435 in series is "C", the aforementioned charging completion voltage between terminals of each of the main bank capacitors 432 and 435 in series is "Vcs", and a voltage between terminals of each of the main bank capacitors 432 and 435 in series after the flash lamp 2 has stopped discharging is "Vce". (This voltage "Vce" is hereafter called a "discharge stop voltage".)

$$E=\{C*((2*Vcs)^2-(2*Vce)^2)\}/2 \quad (1)$$

By substituting E=400 (J), C=0.00625 (F), and Vcs=420 (V) into the equation (1), Vce≈373 (V) can be obtained. This means that a voltage "Vc" between the terminals of each of the main bank capacitors 432 and 435 decreases by 47 volts after the lamp discharging has stopped. With the above charging completion voltage "Vcs" of 420 volts and the discharge stop voltage "Vce" of about 373 volts, the flash lamp 2 can operate in a constant discharge current of about 120 A (amperes). In this way, a constant discharge current can be maintained throughout a period for which the flash lamp 2 emits light. In addition, when a change in the voltage "Vc" is small, a low-cost electrolytic capacitor can be used, instead of an expensive film capacitor.

Figure 4:
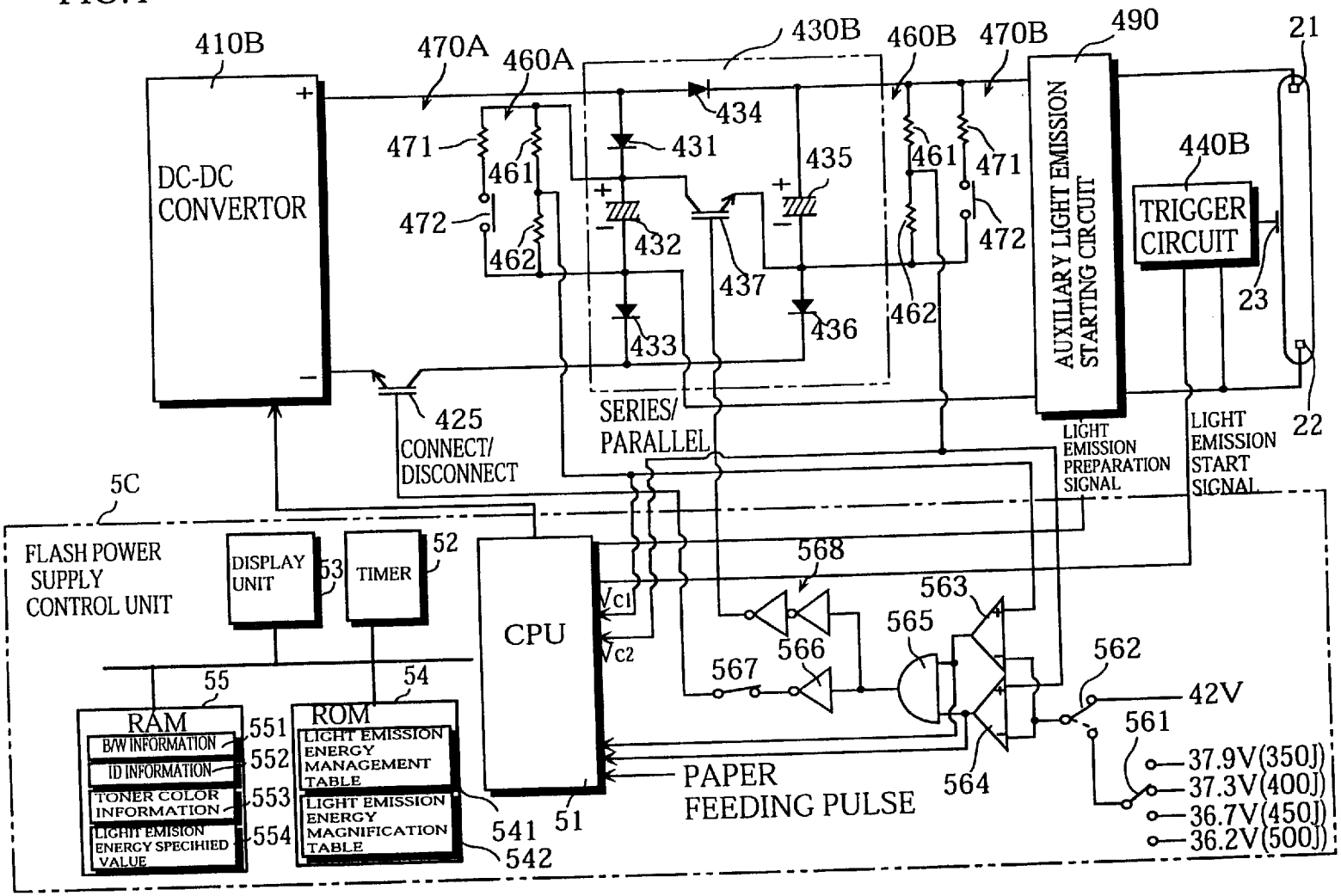
FIG. 4 is a circuit diagram showing constructions of a flash power supply control circuit 5C in the flash device 1 and circuits on its periphery.

The main bank capacitors 432 and 435 are connected in parallel with voltage detecting circuits 460A and 460B, respectively (see FIG. 4). The voltage detecting circuits 460A and 460B each contain voltage dividing resistors 461 and 462 of high resistance. The voltage detecting circuits 460A and 460B detect a voltage "Vc" between terminals of the main bank capacitors 432 and 435, respectively. Further, electric charge releasing circuits 470A and 470B are provided for the main bank capacitors 432 and 435. The electric charge releasing circuits 470A and 470B each contain a resistor 471 of high resistance and a relay switch 472 that is OFF in a normal state. While the power switch 9 is switched to OFF, relay switches 472 are switched to ON to have electric charge accumulated in the main bank capacitors 432 and 435 discharged for safety such as during maintenance. The relay switches 472 are switched between ON and OFF under control of the flash power supply control unit 5C.

Before the flash lamp 2 emits light, the auxiliary light emission starting circuit 490 boosts a voltage to be impressed between main electrodes 21 and 22 of the flash lamp 2 to higher than a voltage of 1,500 volts, in which the flash lamp 2 starts emitting light, by adding 840 volts to the total charging completion voltage of 840 volts of the main bank capacitors 432 and 435. The auxiliary light emission starting circuit 490 contains two auxiliary light emission starting capacitors 492 and 496, diodes 491 and 495 for preventing a backward current, resistors 493, 494, and 497 of high resistance, and SCRs 498 and 499.

In synchronization with charging for the main bank capacitors 432 and 435, the auxiliary light emission starting capacitors 492 and 496 are each fully charged up to a charging completion voltage "Vcs" of 420 volts. These auxiliary light emission starting capacitors 492 and 496 have a small capacity (1 $\mu$F, for instance) and so accumulate low electrostatic energy. On receiving a light emission preparation signal from the flash power supply control circuit 5C, the SCRs 498 and 499 conduct so that the negative terminal of the auxiliary light emission starting capacitor 492 is connected to the positive terminal of the main bank capacitor 435, and the negative terminal of the auxiliary light emission starting capacitor 496 is connected to the positive terminal of the auxiliary light emission starting capacitor 492. At this moment, the main bank capacitors 432 and 435 are connected in series. As a result, the main bank capacitors 432 and 435 are connected in series with the auxiliary light emission starting capacitors 492 and 496, so that 1,680 volts, which are four times as high as the charging completion voltage "Vcs" of each capacitor and larger than a discharge starting voltage of the flash lamp 2, are applied to the main electrodes 21 and 22 of the flash lamp 2. Since the auxiliary light emission starting capacitors 492 and 496 have a small capacity, they complete discharging electric charge shortly after the flash lamp 2 emits light, and electric charge of the main bank capacitors 432 and 435 flows through the SCRs 498 and 499. Due to the resistors 493, 494, and 497 of high resistance, however, a current lower than a holding current of the SCRs 498 and 499 only flows thorough these SCRs 498 and 499. As a result, the SCRs 498 and 499 are promptly set to OFF, and a voltage of the main electrodes 21 and 22 immediately decreases from 1,680 volts to 840 volts. Consequently, a peak value of a discharge current of the flash lamp 2 can be kept low when the flash lamp 2 starts discharging, and its peak width can be also kept narrow.

The trigger circuit 440B applies a trigger signal to the trigger electrode 23 of the flash lamp 2 in response to a light emission start signal from the flash power supply control circuit 5C. The trigger circuit 440B includes a resistor 441 of high resistance, a capacitor 442 which is charged via the resistor 441, a trigger transformer 443 containing a primary winding and a secondary winding, and an SCR 444.

The capacitor 442 is charged by an output of the DC-DC convertor 410B via the resistor 441. The capacitor 442 has a small capacity (1 $\mu$F, for instance) to only accumulate low electrostatic energy. On receiving a light emission start signal from the flash power supply control circuit 5C, the SCR 444 conducts. As a result, electric charge of the capacitor 442 flows at once via the SCR 444 to the primary winding of the trigger transformer 443. This makes the secondary winding generate a high-voltage trigger signal, which is then applied to the trigger electrode 23 of the flash lamp 2. At this moment, the main electrodes 21 and 22 of the flash lamp 2 are given 1,680 volts, which are higher than the discharge starting voltage of the flash lamp 2. As a result, the flash lamp 2 starts emitting light. Shortly after the flash lamp 2 emits the light, the capacitor 442 completes discharging as it has a small capacity. This promptly makes a current passing thorough the SCR 444 lower than its holding current, and so the SCR 444 is set to rectify the current.

Construction of Flash Power Supply Control Circuit 5C

The following describes a construction of the flash power supply control circuit 5C that controls the flash power supply circuit 4C described above.

FIG. 4 is a block diagram showing constructions of the flash power supply control circuit 5C and circuits on its periphery.

The flash power supply control circuit 5C includes the following elements: a CPU 51; a timer 52 connected to the CPU 51; a display unit 53; ROM 54; RAM 55; a discharge stop voltage selecting switch 561 for selecting one discharge stop voltage in accordance with light emission energy of the flash lamp 2; a selecting switch 562 for selecting either a charging completion voltage or a discharge stop voltage; comparators 563 and 564; an AND gate 565; an inverter 566; a charging suspending switch 567; and a delay circuit 568 containing two invertors.

The timer 52 clocks a time used for various purposes in accordance with an instruction from the CPU 51.

The display unit 53 displays various types of information for the user in accordance with an instruction from the CPU 51.

The ROM 54 stores the following in advance: programs for controlling light emission by the flash lamp 2, and checking degradation in the flash lamp 2 and the main bank capacitors 432 and 435; a light emission energy management table 541; and a light emission energy magnification table 542.

The light emission energy management table 541 is used for black toner, and shows relationship between light emission energy required by the flash lamp 2 to emit light once, and the following information: B/W (black/white). information showing a ratio of a number of toner pixels (meaning pixels onto which toner particles are applied) to a number of pixels predetermined in accordance with a size of the sheet of paper "S"; and image density (ID) information showing print density used for the toner pixels. For instance, when the B/W information is shown as 1% to 6%, and the ID information is shown as "0.8", light emission energy of "392J" can be derived from the light emission energy management table 541.

The light emission energy magnification table 542 shows a ratio of light emission energy required to fix color toner of blue, green, and red to light emission energy required to fix black toner, with the ratio for the black toner as "1". For instance, when red toner should be fixed to form an image corresponding to the B/W information shown as 1% to 6% and to the ID information showing as "0.8", the table 542 shows that light emission energy for the red toner is twice as much as 392J for the black toner, that is, 784J.

Light emission energy of about 1.9 J/cm$^2$ is required to fix standard black toner to the piece of paper S. Accordingly, when this black toner is fixed with the fixed width "W" as 50 mm, light emission energy of approximately 400J (400≈1.9×5×42) is required for the flash lamp 2 to emit light once. On the other hand, blue toner, green toner, and red toner require light emission energy of 2.28 J/cm$^2$, 2.47 J/cm$^2$, and 3.8 J/cm$^2$, respectively as they contain less infrared (IR) absorbing agent. Accordingly, for the present embodiment, the fixed width "W" is set to 50 mm for the black toner and to 25 mm for color toner. This increases light emission density of the flash lamp 2 for color toner to twice the light emission density for the black toner.

Note that any problems, such as sublimation, did not occur to the blue and green toner when the fixed width "W" of 25 mm was set for them to give them the same light emission energy of 3.8 J/cm$^2$ as that for the red toner.

In accordance with the above fixed width "W" of 50 mm for the black toner and 25 mm for color toner, and also with the aforementioned system speed of 100 mm/sec, the flash lamp 2 emits light in a cycle of 0.5 second (at a frequency of 2 Hz) and 0.25 second for the black toner and the color toner, respectively. The fixed width "W" and the light emission cycle is controlled by the CPU 51. The reflecting umbrella 3 is constructed in a manner that allows its width to change to provide the above different fixing widths "W".

The RAM 55 contains work areas used when the above programs are executed, and stores B/W information 551, ID information 552, toner color information 553 that have been sent from the image forming unit 10. The RAM 55 also stores a light emission energy specified value 554 obtained with reference to the above stored information and the light emission management table 541 and the light emission energy magnification table 542.

Figure 5:
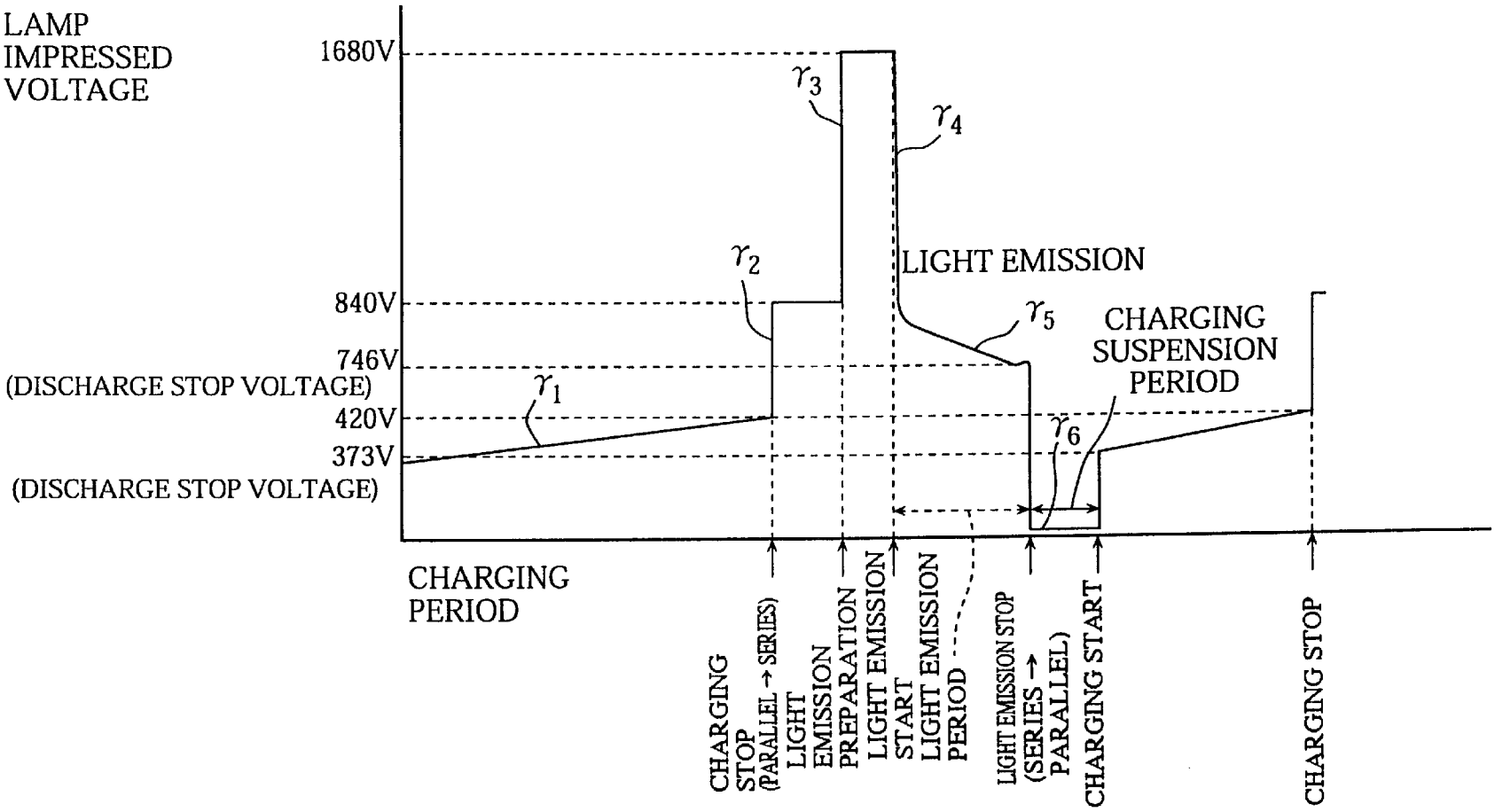
FIG. 5 is a timing chart for a voltage impressed to a flash lamp in the flash lamp device 1 during a fixing operation under control of a CPU 51.

As shown by γ5 in FIG. 5, a voltage "Vc" between terminals of each of the main bank capacitors 432 and 435 gradually decreases from the charging completion voltage "Vcs" in accordance with release of the light emission energy "E" by the flash lamp 2. Accordingly, it is necessary to monitor this decrease in the voltage "Vc" from the voltage "Vcs" and stop the flash lamp 2 from emitting the light as soon as the voltage "Vc" has decreased to the predetermined discharge stop voltage "Vce". This maintains a constant light emission energy of the flash lamp 2 even when impedance of the flash lamp 2 changes due to a passage of time, or a change in temperature characteristics. This discharge stop voltage "Vce" can be derived from the aforementioned equation (1). For the above example where the black toner is fixed to form an image with the B/W information of one to six percent, and the ID information of "0.8", the discharge stop voltage "Vce" of about 373 volts can be obtained from the equation (1). The obtained discharge stop voltage "Vce" is then set in the comparators 563 and 564 to allow the IGBT 437 to be switched to OFF, with the IGBT 425 also being OFF, as soon as the voltage "Vc" of each of the main bank capacitors 432 and 435 has decreased to the set discharge stop voltage "Vce". This prevents a discharge current from flowing to the flash lamp 2, so that the flash lamp 2 stops emitting light, and therefore the light emission energy can be desirably managed.

The discharge stop voltage selecting switch 561 selects, out of the plurality of alternatives, one alternative representing an appropriate discharge stop voltage "Vce" in accordance with the light emission energy specified value 554 under control of the CPU 51. In the figure, "37.3V" is selected as one example.

The selecting switch 562 selects "42V" corresponding to the charging completion voltage "Vcs" when the main bank capacitors 432 and 435 are charged. On the other hand, when the flash lamp 2 discharges, the selecting switch 562 selects the discharge stop voltage "Vce" ("37.3V" for the example in the figure) selected by the discharge stop voltage selecting switch 561.

From the voltage detecting circuits 460A and 460B, the comparators 563 and 564 receive the voltage "Vc" of the main bank capacitors 432 and 435, respectively, thorough their noninverting input terminals, and compares the received voltage "Vc" with a voltage received through their inverting input terminals. In more detail, the comparators 563 and 564 compare the voltage "Vc" with the charging completion voltage (420 volts) when the main bank capacitors 432 and 435 are charged, and compare with the discharge stop voltage (373 volts) while the flash lamp 2 discharges. Note that a voltage selected by the discharge stop voltage selecting switch 561 and the selecting switch 562 is one-tenth of the actual discharge stop voltage "Vce" and charging completion voltage "Vcs" since the resistors 461 and 462 in the voltage detecting circuits 460A and 460B reduce a detected voltage to one-tenth of the detected voltage.

The charging suspending switch 567 delays switching of the IGBT 425 from OFF to ON by a predetermined charging suspending period under control of the CPU 51. This charging suspending period is 100 msec, for instance, which is taken for gas activation inside the flash lamp 2 to subside.

The CPU 51 monitors a voltage "Vc" detected by the voltage detecting circuits 460A and 460B and outputs of the comparators 563 and 564, and controls switchings by the relay switches 402, 404, and 472, the discharge stop voltage selecting switch 561, and the selecting switch 562, and the charging suspending switch 567. The CPU 51 also calculates the light emission energy specified value 554 using the above programs and tables 541 and 542, instructs the DC-DC convertor 410B to start or stop charging with a predetermined timing, and outputs the light emission preparation signal and the light emission start signal to the auxiliary light emission starting circuit 490 and the trigger circuit 440B, respectively. By performing these operations, the CPU 51 efficiently controls fixing operations of the flash device 1.

Operations

The following describes the fixing operations of the flash device 1 under control of the CPU 51 with reference to the timing chart of FIG. 5.

The CPU 51 transfers information to/from a CPU in the image forming unit 10 by executing a main routine. This allows the CPU 51 to receive, for each piece of paper S, the B/W information 551, the ID information 552, and the toner color information 553 from the CPU in the image forming unit 10, and store them into the RAM 55.

The CPU 51 first judges whether the light emission energy, which is required for the flash lamp 2 to emit light once, has been specified based on the B/W information 551 and the I/D information 552 stored in the RAM 55. If not, the CPU 51 specifies the appropriate light emission energy by referring to the light emission energy management table 541 and/or the light emission energy magnification table 542 in the ROM 54, and stores the specified light emission energy in the RAM 55 as the light emission energy specified value 554. Based on the light emission energy specified value 554, the CPU 51 has the discharge stop voltage selecting switch 561 select one appropriate alternative representing a discharge stop voltage "Vce". Note that when the voltage "Vc" of each of main bank capacitors 432 and 435 decreases to this selected voltage of "Vce", supply of the specified light emission energy to the flash lamp 2 stops. When the specified light emission energy is 400J, for instance, the CPU 51 has the discharge stop voltage selecting switch 561 select "37.3V".

Following this, the CPU 51 outputs a charge start instruction to the DC-DC convertor 410B, which then receives a rectified current from the bridge rectifier 405 and outputs a DC voltage of 420 volts. After outputting the charge start instruction, the CPU 51 waits for the voltage "Vc" of each of the main bank capacitors 432 and 435. to reach the charging completion voltage "Vcs" of 373 volts while monitoring outputs from the voltage detecting circuits 460A and 460B.

When the main bank capacitors 432 and 435 charge, the comparators 563 and 564 compare the voltage "Vc" with the charging completion voltage "Vcs" of 420 volts. When obtaining a comparison result showing that the voltage "Vc" is lower than the charging completion voltage "Vcs", the comparators 563 and 564 outputs a low signal. As a result, the AND gate 565 and the delay circuit 568 output a low signal, and the invertor 566 outputs a high signal. The high signal outputted from the invertor 566 is then sent via the charging suspending switch 567 to the IGBT 425 controlling charging operations. On receiving this high signal (i.e., a "connect" signal), the IGBT 425 is switched to ON. On the other hand, the low signal outputted from the delay circuit 568 is sent to the IGBT 437 controlling parallel/series connection state. On receiving this low signal (i.e, a parallel connection signal), the IGBT 437 is switched to OFF. As a result, the main bank capacitors 432 and 435, which are connected in parallel, are connected to output terminals of the DC-DC convertor 410B, so that the main bank capacitors 432 and 435 are charged, and the voltage "Vc", that is, an impressed voltage to the flash lamp 2 increases (see γ1 in FIG. 5). At the same time, the auxiliary light emission starting capacitors 492 and 496 in the auxiliary light emission starting circuit 490, and the capacitor 442 in the trigger circuit 440B are charged.

As soon as the voltage "Vc" between terminals of each of the main bank capacitors 432 and 435 reaches the charging completion voltage "Vcs" of 420 volts, the comparators 563 and 564 output a high signal. As a result, the AND gate 565 and the delay circuit 568 outputs a high signal, while the invertor 566 outputs a low signal. The low signal outputted from the invertor 566 is then sent via the charging suspending switch 567 to the IGBT 425. On receiving this low signal (i.e., a "disconnect" signal), the IGBT 425 is switched to OFF. On the other hand, the high signal outputted from the delay circuit 568 is sent to the IGBT 437 controlling parallel/series connection state. On receiving this high signal (i.e, a series connection signal), the IGBT 437 is switched to ON. As a result, the main bank capacitors 432 and 435 are disconnected from the output terminals of the DC-DC convertor 410B, and connected in series with the flash lamp 2. This doubles the impressed voltage to the flash lamp 2 to 840 volts (see FIG. 5, γ2).

Note that if the IGBT 437 should be switched to ON while the IGBT 425 remains ON, an extraordinary high voltage from the DC-DC convertor 410B would be impressed via the diodes 431 and 436 to the IGBT 437, and the IGBT 437 may be broken. Accordingly, the delay circuit 568 has the IGBT 437 ON only after the IGBT 425 has been switched to OFF, thereby preventing the IGBT 437 from being broken.

The CPU 51 monitors the signal outputted from the comparators 563 and 564 to detect the above transition in the signal from low to high. On detecting this transition, the CPU 51 outputs a light emission preparation signal to the auxiliary light emission starting circuit 490 so that the SCRs 498 and 499 are brought into conduction. Consequently, the main bank capacitors 432 and 435 are connected in series with the auxiliary light emission starting capacitors 492 and 496, and the impressed voltage to the flash lamp 2 raises to 1,680 volts (see γ3 in FIG. 5). Following this, the CPU 51 waits, based on a paper feeding pulse, for a light emitting timing in a light emission cycle to come, and outputs the light emission start signal to the SCR 444 in the trigger circuit 440B with the light emitting timing. This brings the SCR 444 into conduction, so that a trigger signal is outputted to the trigger electrode 23 of the flash lamp 2, and the flash lamp 2 starts emitting light. Immediately after the flash lamp 2 emits the light, the impressed voltage to the flash lamp 2 decreases from 1680 volts to 840 volts due to the small capacity of the auxiliary light emission starting capacitors 492 and 496 (see γ4 in FIG. 5).

During illumination of the flash lamp 2, the comparators 563 and 564 compare the voltage "Vc" with the discharge stop voltage "Vce" of 373 volts. When obtaining a comparison result showing that the voltage "Vc" is higher than the discharge stop voltage "Vce", the comparators 563 and 564 output a high signal. As a result, the AND gate 565 and the delay circuit 568 outputs a high signal, and the invertor 566 outputs a low signal. The high signal is then sent to the IGBT 437 as a series connection signal, so that the IGBT 437 remains ON. On the other hand, the above low signal is sent to the IGBT 425 as a "disconnect" signal, so that the IGBT 425 remains OFF. Consequently, the flash lamp 2 continues to receive the electrostatic energy accumulated in the main bank capacitors 432 and 435, and an approximately constant discharge current flows through the flash lamp 2 while the impressed voltage to the flash lamp 2 gradually decreases (see γ5 in FIG. 5). The flash lamp 2 therefore continues to produce uniform light emission energy proportional to the approximately constant discharge current.

As soon as the voltage "Vc" decreases to the discharging stop voltage "Vce" of 373 volts, the comparators 563 and 564 output a low signal. As a result, the AND gate 565 and the delay circuit 568 outputs a low signal, and the invertor 566 outputs, a high signal. In this case, the IGBT 425 remains OFF since the discharge suspending switch 567 is set to OFF under control of the CPU 51. On the other hand, the low signal outputted from the delay circuit 568 is sent to the IGBT 437 as the parallel connection signal, so that the IGBT 437 is switched to OFF. As a result, a path to conduct the discharge current to the flash lamp 2 is interrupted, and therefore the flash lamp 2 stops emitting the light and the impressed voltage to the flash lamp 2 decreases to zero (see FIG. 5, γ6).

After the flash lamp 2 has stopped emitting the light and the predetermined discharge suspension period has passed, the CPU 51 switches the discharge suspending switch 567 ON, and has the main bank capacitors 432 and 435 start charging. This securely prevents the flash lamp 2 from producing light using follow current after the IGBT 425 is switched to ON and the main bank capacitors 432 and 435 start charging.

When the above operations are repeatedly performed, the light emission energy produced by the flash lamp 2 is intermittently supplied onto the paper S. As a result, light emission energy given per unit time onto surfaces of the black toner and color toner becomes less than light emission energy conventionally given to them. This slowly raises a surface temperature of the black toner, fuses the black toner from its surface without causing a binding agent in the black toner to sublime, and conducts heat energy to beneath the surface of the black toner. For the color toner, a sufficient reaction time is provided, so that the IR absorbing agent contained in the color toner efficiently absorbs the heat energy. As a result, the heat energy is well conducted to beneath the surface of the color toner, which is then completely fused and absorbed between fibers forming the surface of the paper S. As soon as the main bank capacitors 432 and 435 stop discharging, the flash lamp 2 stops irradiating toner with light emission energy. As a result, heat energy accumulated in the toner is released into the air, and a temperature of the toner decreases. The toner absorbed into the paper S is then solidified, and fixed to the paper S completely. This allows the toner to be fixed, drastically reducing toner sublimation and noise caused by the toner sublimation. In a case for which excessive energy is applied to black toner such as when the black toner and color toner are layered together, a temperature of the black toner does not reach its sublimation temperature since the black toner is heated slowly and uniformly as a whole.

The CPU 51 runs degradation diagnostics on the main bank capacitors 432 and 435 during their charging for the following reasons.

When the main bank capacitors 432 and 435 maintain a normal capacity, a voltage "Vc" between terminals of each of the capacitors 432 and 435 rises at a prescribed voltage. build-up rate. If the main-bank capacitors 432 and 435 degrade and their capacity decreases, however, the voltage "Vc" rises at a higher voltage build-up rate than the prescribed build-up rate. On the other hand, the voltage "Vc" raises at a lower build-up rate than the prescribed build-up rate such as when there is a malfunction in charging system, for instance, the DC-DC convertor 410B, or when a short occurs in the main bank capacitors 432 and 435.

Accordingly, the CPU 51 checks the voltage "Vc" between terminals of each of the main bank capacitors 432 and 435 after a prescribed time has passed since they started charging. If the checked voltage "Vc" is equal to a prescribed voltage "Vc1", the CPU 51 judges that the main bank capacitors 432 and 435 are normal. If the checked voltage "Vc" is higher than the prescribed voltage "Vc1", however, the CPU 51 judges that a capacity of the main bank capacitors 432 and 435 decreases, stops the fixing operations, and notifies this to the user by having the display unit 53 display a message. If the checked voltage "Vc" is lower than the prescribed voltage "Vc1", the CPU 51 judges that there is a malfunction in the charging system or that a short occurs in the main bank capacitors 432 and 435, stops the fixing operations, and notifies this to the user by having the display unit 53 display a message.

The CPU 51 also runs capacity diagnosis on the main bank capacitors 432 and 435 when the flash lamp 2 emits light so as to have the main bank capacitors 432 and 435 maintain approximately the same capacity for the following reason.

When a degradation extent of the main bank capacitors 432 and 435 differs, there is a large difference in their capacities. For instance, when a capacity of the main bank capacitor 432 decreases to half the capacity of the main bank capacitor 435 and the two capacitors 432 and 435 continue to be charged, they are charged up to the same charging completion voltage, but the main bank capacitor 432 only accumulates electrostatic energy half the amount the main bank capacitor 435 accumulates. If the flash lamp 2 emits light with the two capacitors 432 and 435 being in this state, a voltage "Vc" between terminals of the main bank capacitor 432 decreases faster than that of the main bank capacitor 435 since the flash lamp 2 consumes light emission energy corresponding to electric charge proportionate to a discharge current. Consequently, the comparator 563 outputs a low signal faster than the comparator 564, so that the AND gate 565 outputs the low signal, and the IGBT 437 is switched to OFF. This stops the flash lamp 2 from producing light before light emission energy of an appropriate amount is discharged.

The CPU 51 therefore checks the voltage "Vc" between terminals of each of the main bank capacitors 432 and 435 after a prescribed time has passed since the flash lamp 2 started emitting the light. If a difference in the checked voltages of the main bank capacitors 432 and 435 is within a prescribed range, the CPU 51 judges that there is no difference in their capacities and they are normal. If a difference in the checked voltages of the two exceeds the prescribed range, however, the CPU 51 judges that a difference in a capacity exists between the two, stops the fixing operations, and has the display unit 53 display a message notifying the user that the difference exists between the two.

Moreover, the CPU 51 runs illumination diagnosis for the flash lamp 2 after the flash lamp 2 starts emitting light.

When the flash lamp 2 has correctly emitted light, the voltage "Vc" between terminals of each of the main bank capacitors 432 and 435 decreases as shown by a curve γ5 in FIG. 5. Should the trigger signal outputted form the trigger circuit 440B be too weak, however, no discharge current flows thorough the flash lamp 2, so that the flash lamp 2 does not emit light, and the voltage "Vc" remains close to the charging completion voltage "Vcs".

The CPU 51 therefore checks the voltage "Vc" after a prescribed time of one msec, for instance, has passed since the output of the light emission start signal. If the checked voltage "Vc" is lower than the charging completion voltage "Vcs" by a predetermined value, the CPU 51 judges that the flash lamp 2 has correctly emitted light, and allows the present discharge to proceed. If the checked voltage "Vc" is not lower than the charging completion voltage "Vcs" by the above predetermined value, the CPU 51 judges that the flash lamp 2 fails to correctly emit light, stops the fixing operations, and immediately outputs the light emission start signal again. After this, the CPU 51 may stop the fixing operations, and have the display unit 53 display a message notifying the user that the flash lamp 2 has failed to emit light.

Example Modifications

The flash device of the present invention has been described based on the above embodiment. However, it should be clear that the present invention is not limited to the above embodiment. Possible example modifications are described below.

In the above embodiment, the CPU 51 stops the fixing operations when a capacity of the main bank capacitors 432 and 435 differs. However, if the capacity difference between the two is calculated as about several percent, it is possible to provide two discharge stop voltage selecting switches like the switch 561 to select two discharge stop voltages in accordance with the capacity difference, and output the two selected discharge stop voltages to the comparators 563 and

564. With this method, the capacity difference between the two can be absorbed.

The color toner may be cyan, yellow, and magenta although blue, green, and red are used as the color toner in the above embodiment.

In the above embodiment, the IGBTs 437 and 425 are used for switching a parallel/series connection state and for controlling charging, respectively. However, it is alternatively possible to use other switching devices, such as a Field Effect Transistor, instead of an IGBT.

In the above embodiment, an AC voltage outputted from the commercial AC power supply 8 is rectified into a DC voltage, and the DC-DC convertor 410B boosts the rectified DC voltage. However, it is alternatively possible to use a battery as a power supply, perform DC-DC conversion on a DC voltage outputted from the battery, and have the DC-DC convertor 410B boost this DC voltage.

A reverse-blocking triode thyristor that is not an SCR may be alternatively used as the above SCRs 498 and 499.

The flash device of the present invention may be also applied to a digital coping machine, a facsimile, a micro reader printer, a device into which some of these devices are combined, and a camera although in the above embodiment the flash device is applied to a laser printer.

Although the present invention has been fully described by way of examples with reference to accompanying drawings, it is to be noted that various changes and modifications will be apparent to those skilled in the art. Therefore, unless such changes and modifications depart from the scope of the present invention, they should be construed as being included therein.

What is claimed is:

1. A flash device, comprising:

a DC power supply;

a flash lamp;

a charging path;

a discharging path;

a group of charge/discharge elements that are charged by the DC power supply, and discharge electric charge to the flash lamp;

a first switch that selectively establishes (a) a parallel state in which the group of charge/discharge elements are connected in parallel with one another, and connected to the DC power supply via the charging path and (b) a series state in which the group of charge/discharge elements are connected in series with the flash lamp via the discharging path, and are connected in series with one another;

a second switch that is positioned in the charging path, and selectively connects and disconnects the group of charge/discharge elements to and from the DC power supply; and a controller that establishes a first control state to have the group of charge/discharge elements charged, and a second control state to have the flash lamp emit light, wherein in the first control state, the second switch performs connection and the first switch establishes the parallel state and wherein in the second control state, the second switch performs disconnection and the first switch establishes the series state.

2. The flash device of claim 1, wherein as soon as the group of charge/discharge elements are fully charged in the first control state, the controller has the second switch perform the disconnection and then has the first switch establish the series state.

3. The flash device of claim 1, wherein as soon as a voltage supplied to the flash lamp becomes lower than a predetermined voltage in the second control state, the controller has the first switch establish the parallel state and then has the second switch perform the connection.

4. The flash device of claim 1, wherein the group of charge/discharge elements accumulate, in total, more electrostatic energy than is required by the flash lamp to emit light once.

5. The flash device of claim 1, further comprising a voltage detecting unit for detecting a voltage between terminals of each of the group of charge/discharge elements.

6. The flash device of claim 5, wherein as soon as the detected voltage reaches a predetermined voltage during a charging of the group of charge/discharge elements, the controller has transition made from the first control state to the second control state.

7. The flash device of claim 5, wherein as soon as the detected voltage becomes lower than a predetermined voltage during illumination of the flash lamp, the controller has transition made from the second control state to the first control state.

8. The flash device of claim 1, wherein the group of charge/discharge elements is a first group of charge discharge elements, and wherein the flash device further comprises an auxiliary light emission start circuit including a second group of charge/discharge elements that are connected in series with the flash lamp and the first group of charge/discharge elements, the flash lamp being connected in series with the first group of charge/discharge elements.

9. The flash device of claim 1, wherein each of the group of charge/discharge elements is a capacitor.

10. A flash-based fixing device that fixes a toner image present on a recording medium onto the recording medium, the flash-based fixing device comprising a flash device which includes:

a DC power supply;

a flash lamp;

a charging path;

a discharging path;

a group of charge/discharge elements that are charged by the DC power supply, and discharge electric charge to the flash lamp;

a first switch that selectively establishes (a) a parallel state in which the group of charge/discharge elements are connected in parallel with one another, and connected to the DC power supply via the charging path and (b) a series state in which the group of charge/discharge elements are connected in series with the flash lamp via the discharging path, the group of charge/discharge elements being connected in series with one another;

a second switch that is positioned in the charging path, and selectively connects and disconnects the group of charge/discharge elements to and from the DC power supply; and a controller that establishes a first control state to have the group of charge/discharge elements charged, and a second control state to have the flash lamp emit light, wherein in the first control state, the second switch performs connection and the first switch establishes the parallel state and wherein in the second control state, the second switch performs disconnection and the first switch establishes the series state.

11. The flash-based fixing device of claim 10, wherein as soon as the group of charge/discharge elements are fully charged in the first control state, the controller has the second switch perform the disconnection and then has the first switch establish the series state.

12. The flash-based fixing device of claim 10, wherein as soon as a voltage supplied to the flash lamp becomes lower than a predetermined voltage in the second control state, the controller has the first switch establish the parallel state and then has the second switch perform the connection.

13. The flash-based fixing device of claim 10, wherein the group of charge/discharge elements accumulate, in total, more electrostatic energy than is required by the flash lamp to emit light once.

14. The flash-based fixing device of claim 10, further comprising a voltage detecting unit for detecting a voltage between terminals of each of the group of charge/discharge elements.

15. The flash-based fixing device of claim 14, wherein as soon as the detected voltage reaches a predetermined voltage during a charging of the group of charge/discharge elements, the controller has transition made from the first control state to the second control state.

16. The flash-based fixing device of claim 14, wherein as soon as the detected voltage becomes lower than a predetermined voltage during illumination of the flash lamp, the controller has transition made from the second control state to the first control state.

17. The flash-based fixing device of claim 10, wherein the group of charge/discharge elements is a first group of charge discharge elements, and wherein the flash-based fixing device further comprises an auxiliary light emission start circuit including a second group of charge/discharge elements that are connected in series with the flash lamp and the first group of charge/discharge elements, the flash lamp being connected in series with the first group of charge/discharge elements.

18. The flash-based fixing device of claim 10, wherein each of the group of charge/discharge elements is a capacitor.

19. An image forming device, comprising:

an image forming unit for forming a toner image on a recording medium; and a flash-based fixing unit that fixes the toner image onto the recording medium and includes a flash device that contains:

a DC power supply;

a flash lamp a charging path;

a discharging path;

a group of charge/discharge elements that are charged by the DC power supply, and discharge electric charge to the flash lamp;

a first switch that selectively establishes (a) a parallel state in which the group of charge/discharge elements are connected in parallel with one another, and connected to the DC power supply via the charging path and (b) a series state in which the group of charge/discharge elements are connected in series with the flash lamp via the discharging path, the group of charge/discharge elements being connected in series with one another;

a second switch that is positioned in the charging path, and selectively connects and disconnects the group of charge/discharge elements to and from the DC power supply; and a controller that establishes a first control state to have the group of charge/discharge elements charged, and a second control state to have the flash lamp emit light, wherein in the first control state, the second switch performs connection and the first switch establishes the parallel state and wherein in the second control state, the second switch performs disconnection and the first switch establishes the series state.

20. The image forming device of claim 19, wherein as soon as the group of charge/discharge elements are fully charged in the first control state, the controller has the second switch perform the disconnection and then has the first switch establish the series state.

21. The image forming device of claim 19, wherein as soon as a voltage supplied to the flash lamp becomes lower than a predetermined voltage in the second control state, the controller has the first switch establish the parallel state and then has the second switch perform the connection.

22. The image forming device of claim 19, wherein the group of charge/discharge elements accumulate, in total, more electrostatic energy than is required by the flash lamp to emit light once.

23. The image forming device of claim 19, further comprising a voltage detecting unit for detecting a voltage between terminals of each of the group of charge/discharge elements.

24. The image forming device of claim 23, wherein as soon as the detected voltage reaches a predetermined voltage during a charging of the group of charge/discharge elements, the controller has transition made from the first control state to the second control state.

25. The image forming device of claim 23, wherein as soon as the detected voltage becomes lower than a predetermined voltage during illumination of the flash lamp, the controller has transition made from the second control state to the first control state.

26. The image forming device of claim 19, wherein the group of charge/discharge elements is a first group of charge discharge elements, and wherein the image forming device further comprises an auxiliary light emission start circuit including a second group of charge/discharge elements that are connected in series with the flash lamp and the first group of charge/discharge elements, the flash lamp being connected in series with the first group of charge/discharge elements.

27. The image forming device of claim 19, wherein each of the group of charge/discharge elements is a capacitor.

28. The image forming device of claim 19, wherein the image forming unit uses black toner and color toner to form the toner image on the recording medium.

* * * * *